United States Patent [19]

Yoshida

[11] Patent Number: 4,490,418

[45] Date of Patent: Dec. 25, 1984

[54] COATING METHOD AND APPARATUS

[75] Inventor: Toru Yoshida, Kanagawa, Japan

[73] Assignee: Fuji Photo Film Co., Ltd., Kanagawa, Japan

[21] Appl. No.: 485,354

[22] Filed: Apr. 15, 1983

[30] Foreign Application Priority Data

Apr. 16, 1982 [JP] Japan ..... 57-63604

[51] Int. Cl.[3] ..... B05D 1/26; B05C 3/132

[52] U.S. Cl. ..... 427/445; 118/410; 118/411

[58] Field of Search ..... 118/410, 407, 411, 412; 427/434.3, 445

[56] References Cited

U.S. PATENT DOCUMENTS 3,916,043 10/1975 Fowble ..... 118/410 X

*Primary Examiner*—Evan K. Lawrence

*Attorney, Agent, or Firm*—Sughrue, Mion, Zinn, Macpeak & Seas

[57] ABSTRACT

A slide bead coating method and apparatus for applying a coating solution onto an advancing web includes an air compressed chamber for keeping a lower side of a solution bead in a pressure-applied condition to produce a difference in pressure between the upper side and the lower side of the solution bead to stabilize the bead. A coating solution which has a low viscosity and good wetting properties can thus be applied onto the web at high speeds and in a thin layer form, and a so-called bead-dropping phenomenon is avoided. Therefore, the preparation of a layer for photo-sensitive materials is facilitated.

9 Claims, 5 Drawing Figures

COATING METHOD AND APPARATUS

BACKGROUND OF THE INVENTION

1. Field of the Invention

The present invention relates to a method and apparatus for applying a liquid coating composition (hereinafter referred to merely as a "coating solution") on a long, continuous and flexible support (hereinafter referred to merely as a "web") which is conveyed past a source of the coating solution.

2. Description of the Prior Art

A so-called, multi-layer slide bead coating apparatus, disclosed by Russell et al in U.S. Pat. No. 2,761,791, has been widely used for applying a coating solution onto a surface of a web. In accordance with this apparatus, the amount of coating solution running down a plurality of tilting surfaces (slide surfaces) is controlled so that it forms a bead at a position where the coating solution comes into close contact with the web being conveyed, and coating is conducted through the bead. Therefore, in apparatuses of this type, it is necessary that the bead be kept stable so that satisfactory coating characteristics can be obtained. However, as the coating speed is increased, it tends to become difficult to maintain such a stabilized bead condition. In addition, it also becomes difficult to maintain a stabilized bead condition as the viscosity and/or the surface tension of the coating solution is reduced.

Japanese patent application (OPI) No. 133067/81 (the term "OPI", as used herein, means a "published unexamined Japanese patent application") discloses a coating device which is capable of discharging at least one coating solution 6, 7 from a coating solution outlet onto a surface of a die block 3, as shown in FIG. 1. The discharged coating solution is allowed to flow over the die surface and, thereafter, is used to be applied to a surface of a web 1 which is advanced around backing roll 2 along a direction A' which is substantially perpendicular to the coating solution. The roll rotates along the direction A, and second and third die blocks 4 and 5 are provided for channeling the first and second coating solutions onto the first die block 3. The first coating solution 6 and the second coating solution 7 are applied to the web 1 to form a first coating layer 9 and a second coating layer 10, respectively. The first coating solution 6 and the second coating solution 7 move as a laminar flow on the plane of the die block 3 and reach the lip of the die block 3 by the action of surface tension, thereby forming a bead 8 between the die block 3 and the web 1. As the web 1 advances, the coating solutions 6 and 7, in superimposed layers, are applied to the web 1 while being stretched to more than twenty or thirty times their original length to form coating films 9 and 10.

In the conventional coating apparatus shown in FIG. 1, the coating solution depends only on surface tension forces for its movement on the plane of the die block 3. Therefore, the thickness of the coating solution which flows over the surface of the die block 3 must be increased to exceed a predetermined value before a bead is formed. Furthermore, no excessive force is exerted on the bead while coating the web 1. It is thus possible to apply a coating solution which has a viscosity of 10 cp or less at high speeds and in a thin layer form. However, when applying a coating solution which has a low viscosity and good wetting properties (i.e., a viscosity of 2 cp or less and a surface tension of 25 dyne/cm or less, such as an organic, solvent-based coating solution), an undesirable phenomenon occurs in which the bead drops from the lip of the coating apparatus in a direction which is opposite to the arrow A'.

U.S. Pat. No. 2,681,294 discloses a bead-stabilizing technique in which, as illustrated in FIG. 2, a coating solution in a coating hopper 11 is fed through a slot 12 to form a coating film 9 on the surface of a web 1. The lower side of a bead 8 is maintained in a pressure-reduced condition by providing a vacuum chamber 13 and operating a valve 14, a liquid trap 15, a manometer 16, and a vacuum pump (not shown) to produce a difference in pressure between the upper side and the lower side of the bead 8. In accordance with this method, when a coating solution which has a low viscosity and good wetting properties (such as an organic, solvent-based coating solution) is coated onto a support, the bead-dropping phenomenon referred to above cannot be avoided, and the bead 8 is broken.

FIG. 3 shows a coating apparatus as described in Japanese patent application (OPI) No. 47039/77. A backing roll 2 is rotated in a direction indicated by the arrow B to allow a web 1 to advance in the direction indicated by the arrow B'. A coating solution is introduced into a cavity 17 in a coating hopper 16 by means of a pump 18 in an amount necessary to form a desired layer thickness on the web 1. The coating solution flows through a slot 19 and is allowed to slide down an inclined surface 20 to form a wedge-shaped coating solution reservoir 8 in a clearance between the coating hopper 16 and the web 1. Then, compressed air at a pressure of about 50–500 mm $H_2O$ is applied to the lower end of the coating solution reservoir from a nozzle 22 of an air compression chamber 21 to form a meniscus. The nozzle 22 and the air compression chamber 21 are located below and adjacent to the coating hopper 16. In this way, a uniform, thin layer is coated at a rate between 50 and 100 m per minute. Since this coating method is based on the same principle as that disclosed in the above-described U.S. Pat. No. 2,681,294 (FIG. 2), when a coating solution which has a low viscosity and good wetting properties (such as an organic, solvent-based coating solution) is applied to the web, a part of the bead is broken. The presence of the air compression chamber 21 thus has an adverse effect on the stability of the bead.

Accordingly, the conventional methods and apparatuses are unsuitable for applying a coating solution which has a low viscosity and good wetting properties (e.g., an organic, solvent-based coating solution) onto the surface of a support since the solution bead tends to be unstable.

It is noted that the term "low viscosity", as used herein, generally means a viscosity of 10 centipoises (cps) or less, and the term "low viscosity and good wetting properties", as used herein, means that the viscosity is 2 cps or less, and the surface tension is 25 dynes per centimeter (dyne/cm) or less. Furthermore, the term "organic solvent" is used herein to mean a solvent-based coating solution in which acetone, methanol, ethanol, methyl chloride, butanol, methyl glycol, methyl ethyl ketone, and ethyl cellulose, for example, are used alone, in combination with each other, or in combination with water, as usually used in the preparation of photographic materials and recording materials.

SUMMARY OF THE INVENTION

An object of the present invention is to prevent the bead-dropping phenomenon from occurring when a coating solution which has a low viscosity and good wetting properties (e.g., an organic solvent) is applied onto the surface of a web.

Another object of the present invention is to make it possible to apply a coating solution which has a low viscosity and good wetting properties (e.g., an organic solvent) onto the surface of a web at high speeds and in a thin layer form.

These objects are attained according to the present invention by advancing the web from the lower side to the upper side of the bead, and by applying pressure to the lower side of the bead to produce a positive pressure differential between the lower side and the upper side of the bead.

The present invention, therefore, relates to a slide bead coating method and apparatus in which the web is advanced from the lower side of a solution bead to the upper side of the solution bead, and a means to maintain the lower side of the bead in a pressure-exerted condition is provided to produce the difference in pressure between the upper side and the lower side of the bead in order to stabilize it.

DETAILED DESCRIPTION OF THE PREFERRED EMBODIMENTS

Figure 4:
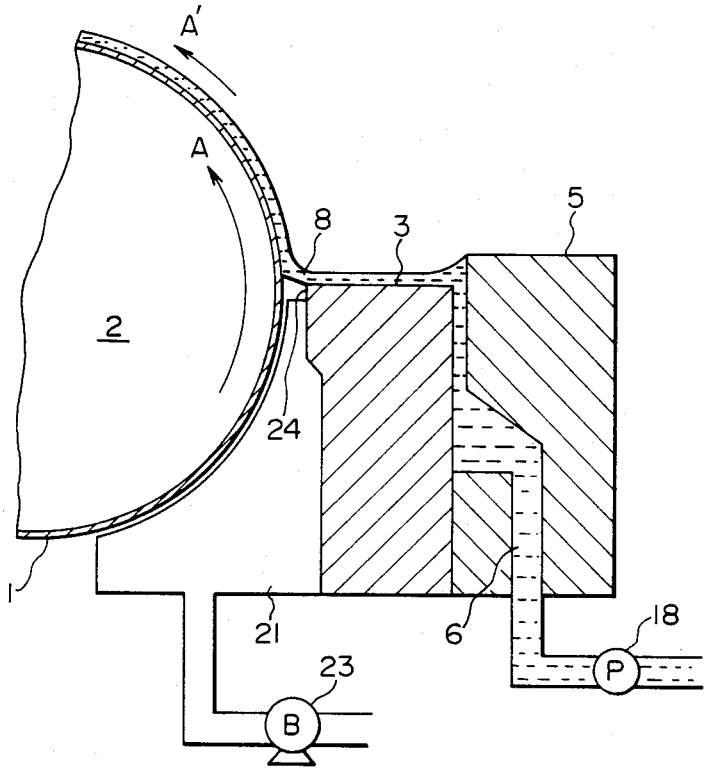
FIG. 4 is a cross-sectional view of a coating apparatus for use in the coating method of the present invention.

FIG. 4 shows a coating apparatus which is constructed in accordance with the present invention. A coating solution 6, fed by a pump 18, flows on the surface of a die block 3 by the action of surface tension. When the coating solution 6 reaches the top left end or lip of the die block, it forms a bead 8 between the die block 3 and the web 1. A backing roll 2 is rotated in the direction indicated by the arrow A to transport the web 1 in the direction shown by the arrow A', i.e., from the lower side of the bead 8 to the upper side. An air compression chamber 21 is provided at the lower side of the bead 8, and compressed air is introduced by means of a blower 23. Accordingly, a difference in pressure is formed between the upper side and the lower side of the bead which stabilizes the bead 8. If the compression chamber 21 is not placed in the pressure-applied condition, when a coating solution which has a low viscosity and good wetting properties (such as an organic solvent-based coating solution) is coated onto the web surface, the coating solution 6 wets and extends on a die block top end lip portion 24, thus making it difficult to form the desired bead 8. The coating solution 6 tends to wet the lip portion 24 of the die block 3 because the die block is easily wetted by the coating solution 6. However, by maintaining the compression chamber 2 in the pressure-applied condition, pressure is exerted on the bead 8 from its lower side to its upper side which lifts the bead 8 upward. Accordingly, the bead is stabilized.

Figure 5:
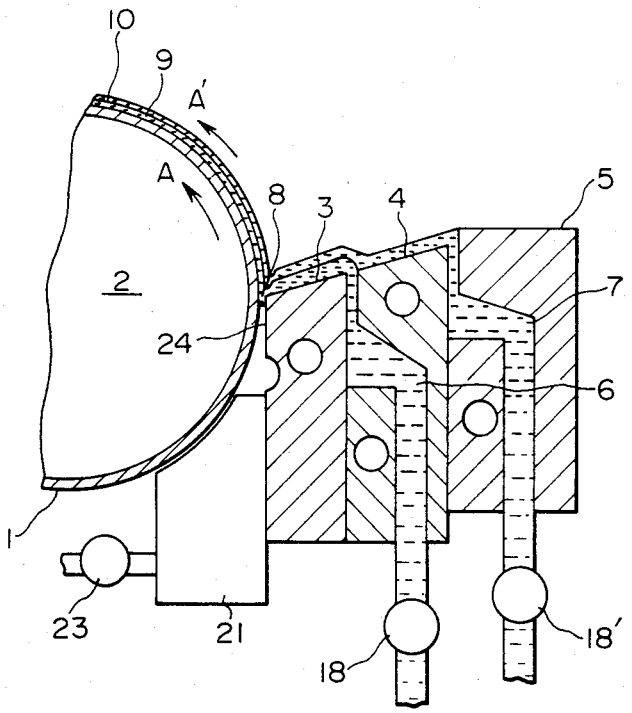
FIG. 5 is a cross-sectional view of another coating apparatus for use in the coating method of the present invention.

FIG. 5 shows a coating apparatus which is used when the coating method of the present invention is applied to the slide bead coating. A first coating solution 6 and a second coating solution 7 are applied by means of pumps 18 and 18', respectively. The coating solutions flow down the inclined surfaces of die blocks 3 and 4 as a superimposed flow, due to the action of gravity, and reach the lip of the die 3 where they form a bead 8 between the die block 3 and a web 1. A backing roll 2 is rotated in the direction shown by the arrow A to transport the web 1 in the direction indicated by the arrow A'. A compression chamber 21 is provided at the lower side of the bead 8, and compressed air is introduced into the compression chamber blower 23 which produces a difference in pressure between the upper side and the lower side of the bead 8. This difference in pressure leads to the stabilization of the bead. The phenomenon occurring at the lip portion 24 of the die block is nearly the same as that described in connection with FIG. 4.

The coating method and apparatus of the present invention prevents the solution bead from dropping when a coating solution which has a low viscosity and good wetting properties (e.g., an organic solvent) is coated on a web. Furthermore, the coating method and apparatus of the present invention makes it possible to apply such coating solutions at high speeds and in a thin layer form.

Even in the conventional coating methods and apparatuses, the above-described, bead-dropping phenomenon can be prevented by increasing the amount of coating solution supplied to the web, which increases the thickness of the resulting coating solution layer applied onto the web. However, this method increases the drying load required to dry the coated layers and it also wastes an undue amount of the coating materials. On the other hand, in accordance with the present invention, the bead-dropping phenomenon is prevented while conducting high-speed thin layer coating.

The following examples and comparative examples are given to demonstrate the effects of the present invention.

EXAMPLE

An acetone/methanol (4/6 by volume) mixed coating composition which has a viscosity of 0.75 cp and a surface tension of 23.7 dyne/cm (all being determined at 20° C.) was coated on a web of cellulose triacetate at a rate of 100 m per minute.

COMPARATIVE EXAMPLE 1

Figure 1:
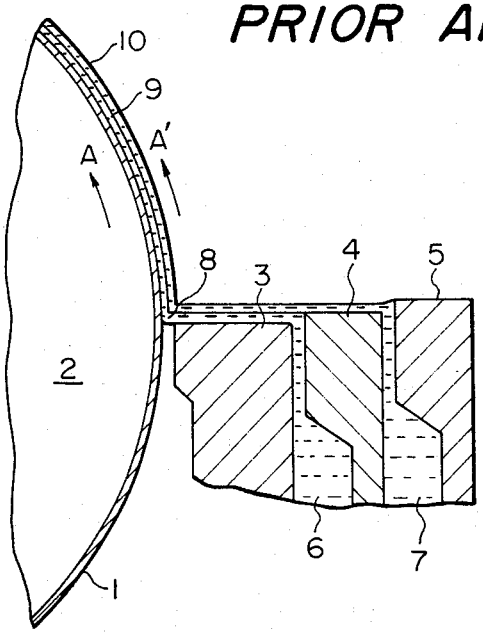
FIG. 1 PRIOR ART
FIGS. 1 to 3 are cross-sectional views which schematically illustrate conventional coating methods and coating apparatuses.

Using the coating apparatus shown in FIG. 1, the mixed coating composition could be coated stably in a thin layer form up to 31 ml per square meter. However, when the amount of coating solution was decreased, the bead-dropping phenomenon occurred.

COMPARATIVE EXAMPLE 2

Figure 2:
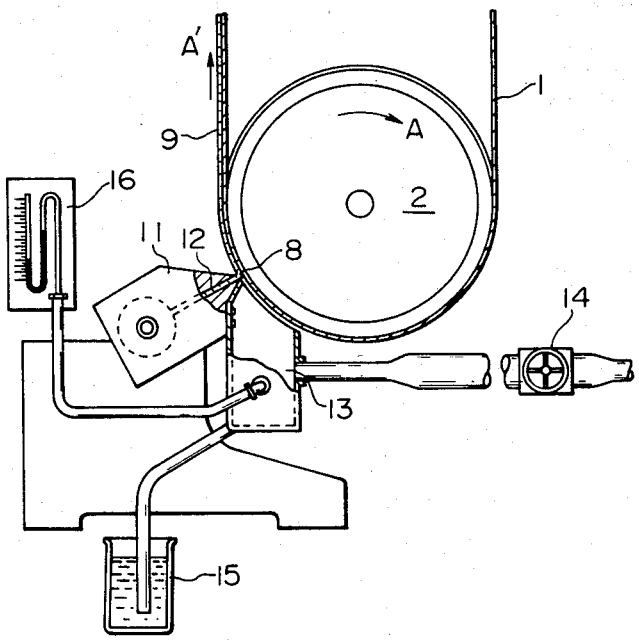
FIG. 2 PRIOR ART
Figure 3:
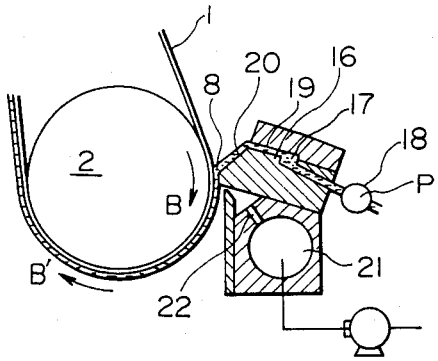
FIG. 3 PRIOR ART

In accordance with the coating method shown in FIG. 2, unless the amount of the mixed coating composition being coated was increased to about 100 ml per square meter, the bead-dropping phenomenon occurred and coating became impossible. In this case, the pressure in the pressure-reduced chamber 13 was −10 to −60 mm $H_2O$.

EXAMPLE 1

In the coating apparatus shown in FIG. 4, when the compression chamber 21 was adjusted to 6–10 mm $H_2O$, thin layer coating could be performed stably until the coating amount was reduced to 18 ml per square meter.

Although the above experiments were performed at a coating speed of 100 m per minute, nearly the same phenomenon is expected to occur until the coating speed reaches 200 m per minute.

The coating method and apparatus of the present invention is particularly useful in coating of photo-sensitive materials.

Solvents which can be used for this purpose include: alcohols, such as methanol, ethanol, isopropanol, methoxyethanol, acetoxyethanol, ethoxyethanol, ethylene glycol, diethylene glycol, propylene glycol, methoxypropanol, phenoxyethanol, phenylpropanol, cyclohexanol, benzyl alcohol, phenol, tert-butyl-phenol, furfuryl alcohol, and tripropylene glycol; hydrocarbons, such as hexane, ligloin, cyclohexane, decalin, and octane; halogenated hydrocarbons, such as dichloromethane, chloroform, methylchloform, carbon tetrachloride, dichloroethane, trichloroethane, chlorobenzene, and dichlorobenzene; ethers, such as ethyl ether, dimethoxy ethane, diisopropyl ether, ethyle phenyl ether, tetrahydrofuran, anisol, propylene oxide, and morpholine; aromatic hydrocarbons, such as benzene, toluene, xylene, ethylbenzene, cymene, cumene, and styrene; lactones and lactams, such as butyrolactone, acetylbutyrolactone, pyrrolidone, N-methylpyrrolidone, and vinylpyrrolidone; amides, such as dimethylformamide, diethylformaide, formamide, diethylacetamide, formylmorpholine, dimethylacetamide, hexamethylphosphoramide, and methylurea; ketones, such as acetone, methyl ethyl ketone, mesityl oxide, methyl isobutyl ketone, diacetone alcohol, cyclohexanone, methylcyclohexanone, and acetophenone; acetonitrile; nitropropane; dimethyl cyanamide; carbon disulfide; dimethysulfoxide; methylethylsulfoxide; diethylsulfoxide; sulforane; esters such as methyl formate, dimethyl phthalate, methyl acetate, butyl acetate, $\beta$-methoxyethyl acetate, $\beta$-butoxyethyl acetate, propyl propionate, dimethyl oxalate, and dimethyl maleate; acids, such as formic acid, acetic acid, butylic acid, acrylic acid, and methacrylic acid; and amines, such as pyridine.

From these compounds, one or more suitable solvents can be easily selected by taking into consideration solubility, ease of drying, reactivity, odor, compatibility with water, and price. Nevertheless, the invention is not limited to the abovedescribed examples and organic solvents, and a water-based coating solution which has a low viscosity and good wetting properties can also be used in the coating method of the invention. Thus, a coating method using such a water-based coating solution is included within the scope of the invention.

As for the construction of the web, flexible supports (such as polyester bases, plastic films, cellophane, paper and thin metallic plates) can be used.

Furthermore, the method and apparatus of the invention can be utilized in hopper slide coating and extrusion bead coating. The concept of the invention is also applicable to an extrusion type coating apparatus, as disclosed in British Pat. No. 1,159,598.

I claim:

1. The method of coating an advancing web, comprising the steps of:

feeding a coating solution having a viscosity of no more than 2 cp and a surface tension not greater than 25 dyne/cm from a die block to a surface of a web so that a coating solution bead is formed between said die block and said web;

advancing said web past said solution bead so that said web travels from a lower side of said solution bead to an upper side of said solution bead; and applying pressure to said lower side of said solution bead to create a positive pressure differential between said lower side and said upper side of said solution bead to support and stabilize said solution bead.

2. The coating method as claimed in claim 1 wherein said web comprises a long, continuous, flexible support.

3. The coating method as claimed in claim 1 wherein said web is advanced by a roll.

4. The coating method as claimed in claim 1 wherein said pressure is applied by a blower which blows compressed air into an air compression chamber located beneath said lower side of said solution bead so as to be adjacent thereto.

5. The coating method as claimed in claim 4 wherein an upper surface of said die block is inclined downwards towards said web.

6. An apparatus for applying a coating solution onto a surface of a web, comprising:

a first die block;

a roll for advancing said web past an edge of said first side block, said web surface being spaced apart from said die block edge;

means for pumping said coating solution onto said die block edge to form a solution bead between said web surface and said die block edge, said web surface being transported by said roll from a lower side of said solution bead to a upper side of said solution bead; and means for creating a positive pressure differential between said lower side and said upper side of said solution bead.

7. The apparatus as claimed in claim 6 wherein said pressure differential creating means comprises an air compression chamber located beneath said die block, and a blower for blowing compressed air into said air compression chamber.

8. The apparatus as claimed in claim 6 wherein said coating solution has a viscosity of no more than 2 cp and a surface tension no greater than 25 dyne/cm.

9. The apparatus as claimed in claim 6 further comprising: a second die block, wherein said pumping means pumps said coating solution between said first and second die blocks onto the side of the upper face of said first die block opposite said roll, and further comprising a third die block and second pumping means for pumping a second coating solution between said second and third die blocks onto the side of the upper face of said second die block opposite said first die block and then onto said edge of said first die block, an upper surface of said first die block being inclined downwards toward said web surface.

* * * * *